US009183694B2

(12) United States Patent
Endo et al.

(10) Patent No.: US 9,183,694 B2
(45) Date of Patent: Nov. 10, 2015

(54) GAMING MACHINE

(75) Inventors: Yoshihide Endo, Tokyo (JP); Takashi Izawa, Tokyo (JP)

(73) Assignee: ARUZE GAMING AMERICA, INC., Las Vegas, NV (US)

( * ) Notice: Subject to any disclaimer, the term of this patent is extended or adjusted under 35 U.S.C. 154(b) by 1158 days.

(21) Appl. No.: 12/615,822

(22) Filed: Nov. 10, 2009

(65) Prior Publication Data

US 2010/0120539 A1 May 13, 2010

Related U.S. Application Data

(60) Provisional application No. 61/114,149, filed on Nov. 13, 2008, provisional application No. 61/114,155, filed on Nov. 13, 2008.

(51) Int. Cl.
*A63F 13/90* (2014.01)
*G07F 17/32* (2006.01)

(52) U.S. Cl.
CPC ..... *G07F 17/32* (2013.01); *G07F 17/3202* (2013.01); *G07F 17/3216* (2013.01)

(58) Field of Classification Search
CPC ..... G07F 17/3202; G07F 17/3211; G07F 17/3216
USPC ..... 463/16–20, 47
See application file for complete search history.

(56) References Cited

U.S. PATENT DOCUMENTS

| | | | | |
|---|---|---|---|---|
| 2005/0113174 | A1* | 5/2005 | Izawa | 463/46 |
| 2006/0030412 | A1* | 2/2006 | Cole | 463/46 |
| 2007/0284814 | A1 | 12/2007 | Hirato et al. | |
| 2007/0287527 | A1 | 12/2007 | Tanabe et al. | |
| 2007/0287528 | A1 | 12/2007 | Hirato et al. | |
| 2007/0287538 | A1 | 12/2007 | Ishikawa et al. | |
| 2007/0287543 | A1 | 12/2007 | Tanabe | |
| 2007/0287544 | A1 | 12/2007 | Hirato et al. | |
| 2008/0004099 | A1 | 1/2008 | Ikeda | |
| 2008/0113749 | A1* | 5/2008 | Williams et al. | 463/20 |
| 2008/0153569 | A1 | 6/2008 | Tanabe | |

FOREIGN PATENT DOCUMENTS

| | | |
|---|---|---|
| JP | 2002085635 | 3/2002 |
| JP | 2004057665 | 2/2004 |

OTHER PUBLICATIONS

Death Race—Exidy Service Manual, circa 1976 http://www.arcade-museum.com/manuals-videogames/D/DeathRace.pdf.*
"Cabinet Speaker Replacement Using a 6-1/2 Inch Woofer" by Joseph A. Dziedzic https://web.archive.org/web/20071223172218/http://www.dziedzic.us/wpc_speaker_65_cabinet.html.*

* cited by examiner

*Primary Examiner* — Ronald Laneau
*Assistant Examiner* — Ross Williams
(74) *Attorney, Agent, or Firm* — Lex IP Meister, PLLC

(57) ABSTRACT

A gaming machine has an armrest for a player to rest his/her arm(s) thereon. The armrest has a woofer specialized in low-pitched sound output inside the armrest. Vibrations produced with the sound output of the woofer are transmitted to the player through the armrest.

7 Claims, 10 Drawing Sheets

GAMING MACHINE

CROSS-REFERENCE TO RELATED APPLICATIONS

This application is based upon and claims a priority from the U.S. provisional Patent Application No. 61/114,155 filed on Nov. 13, 2008, the U.S. provisional Patent Application No. 61/114,149 filed on Nov. 13, 2008, the entire contents thereof are incorporated herein by reference.

BACKGROUND

1. Technical Field

One or more aspects of the present invention relate to a gaming machine having a woofer that outputs sounds in a low pitch range.

2. Description of Related Art

Conventionally, various types of gaming machines are installed in game arcades. The various types of gaming machines include a slot machine, a card game machine and so on. These gaming machines stimulate players' interests in games through performing various effects. The various effects include a visual effect based on display on a display device, an auditory effect by sounds output from a speaker and an effect of luminescence by a luminescent device (for instance, LED, etc.).

Here, as one type of these gaming machines, there is a heretofore known gaming machine having two types of speakers. The two types of speakers are the ones called a tweeter, and a woofer. The tweeter is a speaker specialized in outputting sounds corresponding to a high-pitch range in the human auditory range. The woofer is a speaker specialized in outputting sounds corresponding to a low-pitch range in the human auditory range.

In other words, this type of gaming machine can output stable sounds covering the whole human auditory range, using speakers. As a result, this type of gaming machine can appropriately transmit a sound effect etc. on a game to a player. Accordingly, this type of gaming machine can stimulate a player's interest through effects based on the sound output. Here, a gaming machine which can further stimulate the player's interest has been demanded.

In addition, such gaming machines house components used for control with respect to games in their cabinets. Such components include a motor, and a control board having a processor etc. thereon. When the gaming machines are operating, these components generate heat. Then, when the temperatures in the cabinets rise, the components may cause malfunction (such as abnormal operation of control programs).

Incidentally, there is a gaming machine having a vent hole in the back surface of the cabinet formed in a plane shape. This vent hole provides communication between the inside and the outside of the cabinet. The gaming machine circulates the air between the inside and the outside of the cabinet through the vent hole. Accordingly, the gaming machine can release the heat generated inside the cabinet to the outside of the cabinet. As a result, the gaming machine can prevent operational failure due to the heat of the components. In this regard, the gaming machine requires a certain size of space at the back face side of the cabinet so as to emit heat exhaust through the vent hole assuredly.

Meanwhile, managers of game arcades wish to install more gaming machines in their game arcades. Such managers of game arcades wish to offer more comfortable environment to players who play games in their game arcades.

In other words, the managers of game arcades wish to offer convenience to players by effectively utilizing spaces in their game arcades.

This invention provides a gaming machine which can further enhance the impact of the sound effect. In addition, this invention provides a gaming machine which can stimulate a player's interest in a game. Further, this invention provides a new gaming machine which can prevent a malfunction caused by the heat generated inside the cabinet. Further, the present invention provides a new gaming machine which can reduce spaces for installation in game arcades.

SUMMARY

The gaming machine according to one or more aspects of the present invention comprising: a cabinet comprising: a control board housed therein, the control board including a processor for executing control with respect to a game, and a display arranged in a front face thereof, the display for displaying information with respect to the game; an armrest protruding further frontward from the cabinet than the display; and a woofer housed inside the armrest, the woofer for outputting low pitched sounds based on a signal from the processor.

When playing a game with the present gaming machine, a player executes operations concerning the game while he/she puts his/her arm(s) on the armrest. Here, a vibration system (for instance, a diaphragm, etc.) of the woofer has a long stroke design so that the woofer is specialized in outputting low-pitched sounds. Accordingly, when outputting low-pitched sounds with the woofer built in the armrest, vibrations produced by the output of the low-pitched sounds are transmitted to the armrest. Accordingly, the present gaming machine can execute an effect concerning the tactile perception of a player, simultaneously with a sound effect. As a result, the present gaming machine can further stimulate the player's interest in a game.

The gaming machine according to one or more aspects of the present invention comprising: a cabinet comprising: a control board housed therein, the control board including a processor for executing control with respect to a game, and a display arranged in a front face thereof, the display for displaying information with respect to the game; a relay board connected to the control board; an armrest protruding further frontward from the cabinet than the display; and a woofer inside the armrest, arranged in a bottom surface of the armrest in a condition that directivity with respect to sound output of the woofer is in a downward direction of the armrest, the woofer for outputting low pitched sounds based on a signal from the processor, wherein the woofer is detachably connected to the relay board, and wherein, through the relay board, the processor controls the sound output of the woofer.

Accordingly, this gaming machine can further stimulate a player's interest in a game similar to the above-mentioned gaming machines. This gaming machine can prevent modification to the main portion of the gaming machine, thus preventing a fraud due to the modification etc. of the main portion. This gaming machine can also reduce the workload of the operator at the replacement of the woofer. At this gaming machine, the woofer is arranged in the underside of the armrest in a condition that the directivity with respect to the sound output thereof is in the downward direction of the armrest. That is, the woofer is arranged in a condition that a diaphragm and so on, which configure the woofer, are facing in the direction of the underside of the armrest. As a result, this gaming machine can prevent a malfunction of the woofer caused by liquids (for instance, a drink, etc.) spilt to a diaphragm and so on.

A gaming machine according to one or more aspects of the present invention comprising: a cabinet housing a device used for execution and generates heat while in operation; a recess portion formed in an outer peripheral surface of the cabinet, the recess portion being recessed in a predetermined length from the outer peripheral surface of the cabinet and communicating with an upper surface of the cabinet; an exhaust hole formed in the recess portion, the exhaust hole communicating with an inside of the cabinet; and an exhaust fan exhausting air inside the cabinet through the exhaust hole to an outside.

As described above, the gaming machine has an exhaust hole which provides communication between the outside of the cabinet and an exhaust fan.

Accordingly, the gaming machine can release the heat generated inside the cabinet, thereby preventing a malfunction of the components (such as a processor) caused by heat. Further, the gaming machine has a recess portion being recessed in a predetermined length from the outer peripheral surface of the cabinet. The exhaust hole is formed in this recess portion. Therefore, even when the gaming machine is arranged with its outer peripheral surface in contact with a wall surface and the like of a game arcade, the gaming machine can secure a certain size of space required to exhaust air between the exhaust hole and the wall surface of the game arcade. In other words, the gaming machine can be arranged in the game arcade with the outer peripheral surface thereof in contact with the wall surface and the like of the game arcade. As a result, the gaming machine can reduce a space for installing the gaming machine, thereby contributing to effective use of spaces in game arcades. Additionally, in the gaming machine, the recess portion communicates with the upper portion of the cabinet. Therefore, even when a plurality of gaming machines are arranged in line with their outer peripheral surfaces in contact with each other, air can be assuredly exhausted from the exhaust holes.

One or more aspects of the present invention as above mentioned will be sufficiently understood by the following detailed description along with reading related drawings. However, it will be clearly understood that the drawings are merely for a purpose of illustrating and that they are not intended to define the limit of the present invention.

DETAILED DESCRIPTION

Figure 1:
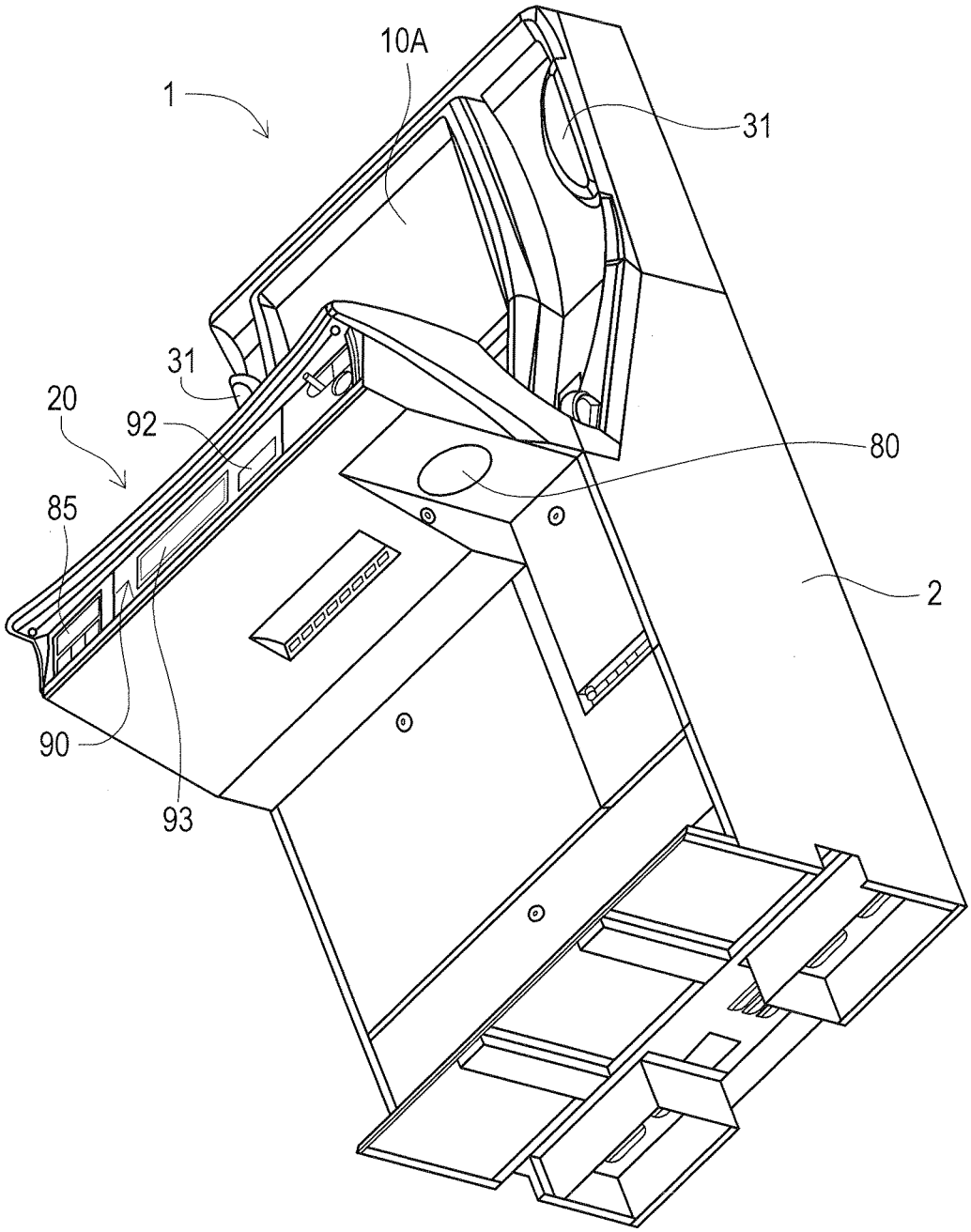
FIG. 1 is an explanatory diagram illustrating a feature of a slot machine according to the first embodiment of the present invention.

The various aspects summarized previously may be embodied in various forms. The following description shows by way of illustration of various combinations and configurations in which the aspects may be practiced. It is understood that the described aspects and/or embodiments are merely examples, and that other aspects and/or embodiments may be utilized and structural and functional modifications may be made, without departing from the scope of the present disclosure.

It is noted that various connections are set forth between items in the following description. It is noted that these connections in general and, unless specified otherwise, may be direct or indirect and that this specification is not intended to be limiting in this respect.

A gaming machine according to one or more aspects of the invention will be described in detail with reference to the drawings based on an embodiment embodying one or more aspects of the invention. However, it is appreciated that one or more aspects of the present invention may be embodied in distributable (via CD and the like) or downloadable software games, console games, and the like. In this regard, the slot machine may be a virtual slot machine that is displayed on a multi-purpose computer and/or dedicated kiosk. Aspects of the invention are described by way of hardware elements. However, it is appreciated that these elements may also be software modules that are executable in a computer. The software modules may be stored on a computer readable medium, including but not limited to a USB drive, CD, DVD, computer-readable memory, tape, diskette, floppy disk, and the like. For instance, aspects of the invention may be embodied in a JAVA-based application or the like that runs in a processor or processors. Further, the terms "CPU", "processor", and "controller" are inclusive by nature, including at least one of hardware, software, or firmware. These terms may include a portion of a processing unit in a computer (for instance, in multiple core processing units), multiple cores, a functional processor (as running virtually on at least one of processor or server, which may be local or remote). Further, in network-based gaming systems, the processor may include only a local processor, only a remote server, or a combination of a local processor and a remote server.

It is contemplated that one or more aspects of the invention may be implemented as computer executable instructions on a computer readable medium such as a non-volatile memory, a magnetic or optical disc. Further, one or more aspects of the invention may be implemented with a carrier signal in the form of, for instance, an audio-frequency, radio-frequency, or optical carrier wave.

[First Embodiment]

A gaming machine according to the first embodiment will be described in detail with reference to the drawings as embodied in a slot machine 1.

The features of the slot machine 1 according to the present invention will be described in detail with reference to the drawings. The slot machine 1 according to the first embodiment is a so-called hybrid-type slot machine. This hybrid-type slot machine has a known transmissive liquid crystal panel arranged in front of a plurality of mechanical reels. The plurality of mechanical reels are rotatably supported. This hybrid-type slot machine turns the transmissive liquid crystal panel into a transparent state when executing a game so as to allow the images of various symbols depicted on the outer peripheral surface of the mechanical reels to be displayed.

Figure 2:
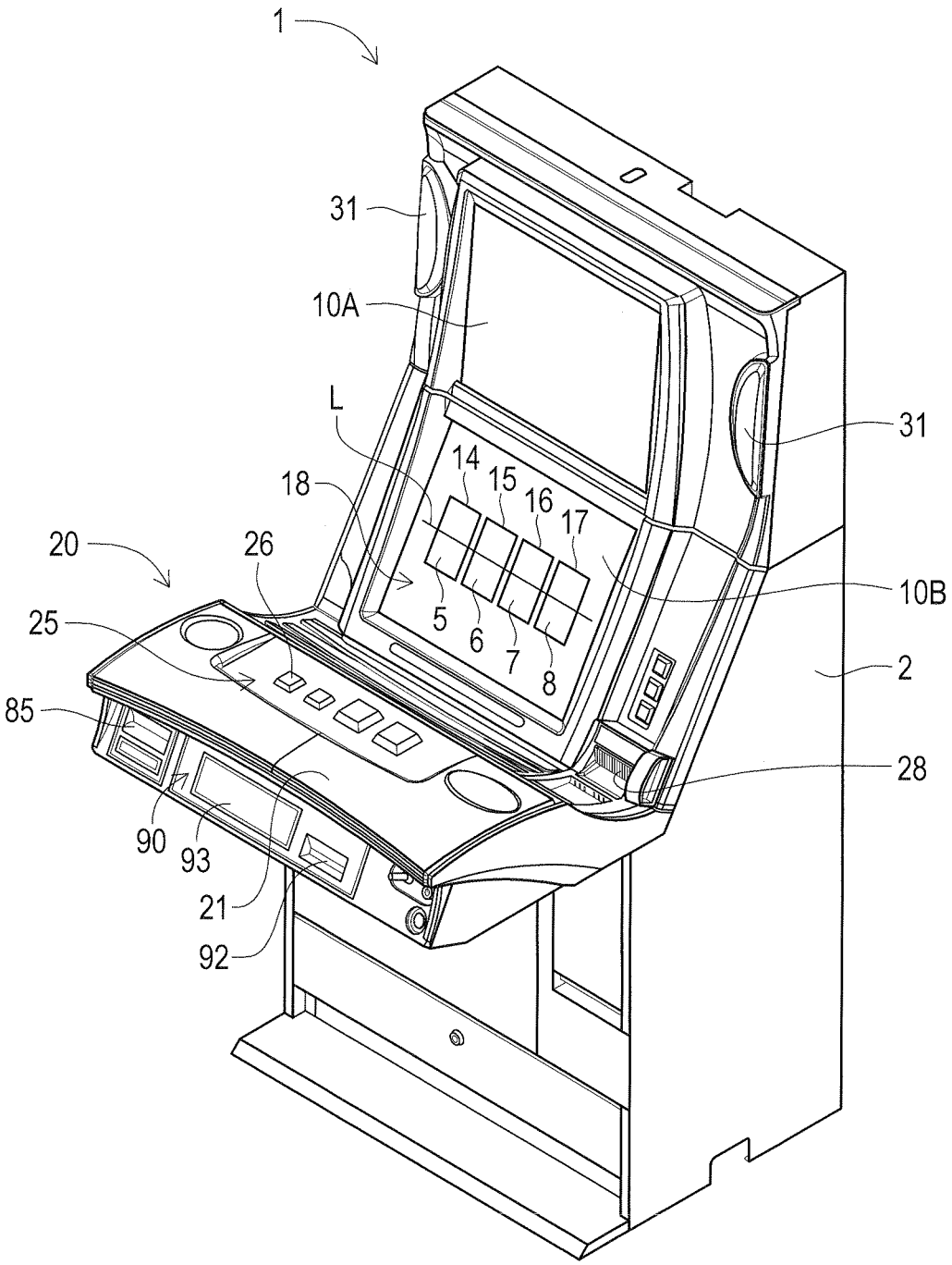
FIG. 2 is a perspective view illustrating an outer appearance of the slot machine according to the first embodiment of the present invention.

Also, the slot machine 1 is a slanted-type slot machine as is installed in game arcades such as casinos (refer to FIG. 1 and FIG. 2). In a case of the slanted-type slot machine, the player plays a game while sitting on a seat arranged in front of the slot machine.

Here, the slot machine 1 according to the first embodiment has an armrest 20. The armrest 20 is protruded forward (in other words, in the direction of the player playing a game at the slot machine 1) from the front face of the slot machine 1. Therefore, a player rests his/her arm(s) (or his/her elbow(s)) on the armrest 20 while playing a game in the slot machine 1.

Figure 5:
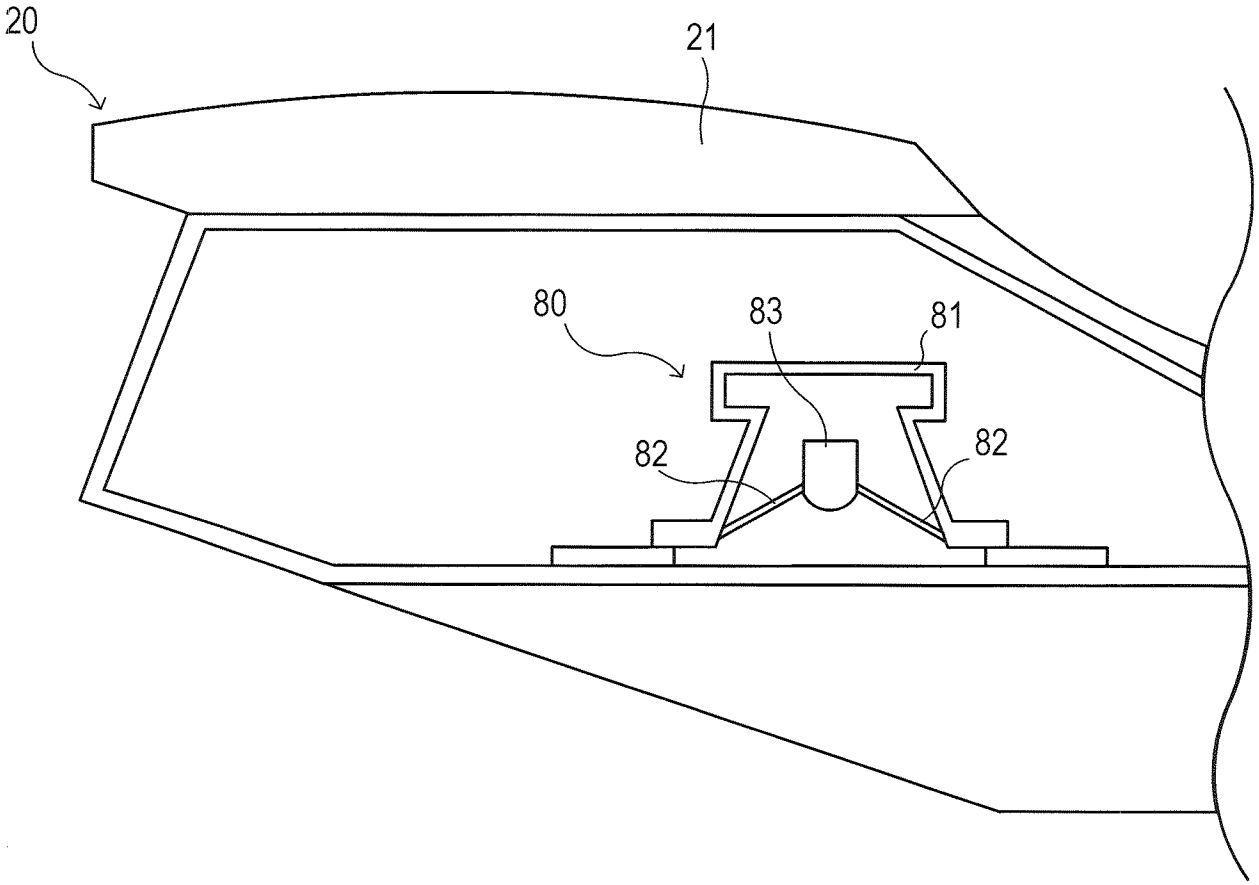
FIG. 5 is a sectional side view in an area including a woofer of an armrest according to the first embodiment of the present invention.

The armrest 20 houses a woofer 80 therein (refer to FIG. 1 and FIG. 5). The woofer 80 is a speaker specialized in outputting sounds corresponding to the low-pitch range in the human auditory range. The vibration system (for instance, the diaphragm 82 etc.) of the woofer 80 has a large stroke so that the woofer 80 is specialized in the output of the low-pitched sounds, so that. When the woofer 80 outputs low-pitched sounds, the movement of a diaphragm 82 vibrates the woofer 80. The vibrations produced in the woofer 80 are transmitted to the player through the armrest 20. As a result, the slot machine 1 can execute the vibration effect along with the audio effect through the woofer 80. Accordingly, the slot machine 1 can further improve the result of the audio effect, and can further stimulate the player's interest in the game.

Next, the slot machine 1 according to the first embodiment will be described in detail with reference to the drawings. FIG. 2 is a perspective view showing an outer appearance of the slot machine 1 according to the first embodiment.

As shown in FIG. 2, the slot machine 1 has a cabinet 2. The cabinet 2 houses electrical and mechanical components for executing predetermined game aspects in the slot machine 1. For instance, the main control board 71 to be described later is housed in the lower portion of the cabinet 2. Four reels (specifically, a first reel 5, a second reel 6, a third reel 7 and a fourth reel 8) are provided inside the cabinet 2 in a freely rotating fashion. The first reel 5 through the fourth reel 8 each have a symbol string drawn on an outer peripheral surface thereof. Each symbol string is made up of a predetermined number of symbols. Also, each symbol string includes a plurality of types of symbols.

The cabinet 2 has an upper display 10A and a main display 10B provided at a front face thereof. The upper display 10A is arranged at an upper front portion of the cabinet 2. The upper display 10A is made up of a heretofore known liquid crystal panel. The upper display 10A displays information with respect to the game to be played on the display surface 11A. The display contents to be displayed on the upper display 10A include effect images, introduction of the game contents, game rule explanations and the like.

The main display 10B is arranged at a middle front of the cabinet 2. The main display 10B is made up of a heretofore known transmissive liquid crystal panel or the like. The main display 10B displays information with respect to the game. Specifically, the player progresses the game in the slot machine 1 based on the display of the main display 10B.

The main display 10B has a first display window 14, a second display window 15, a third display window 16 and a fourth display window 17. As described earlier, the first reel 5 through the fourth reel 8 are arranged inside the cabinet 2. The main display 10B is positioned in front of the first reel 5 and the fourth reel 8. In the main display 10B, the first display window 14 through the fourth display window 17 are formed at portions corresponding to the first reel 5 through the fourth reel 8. For instance, the first display window 14 is formed at a position corresponding to the front of the first reel 5 of the main display 10B. In the slot machine 1, the inner side of the first display window 14 through the fourth display window 17 can be changed to a transparent state. This enables players to view behind the main display 10B through the first display window 14 through the fourth display window 17. Specifically, the players can see the symbols drawn on the first reel 5 through the fourth reel 8 through the first display window 14 through the fourth display window 17. The main display 10B displays one pay line L (refer to FIG. 2 and FIG. 4).

The pay line L crosses the center of the first display window 14 through the fourth display window 17 in a horizontal fashion. The pay line L defines a symbol combination constituting the game results. Accordingly, if the symbol combination which has been repositioned on the pay line L is a predetermined winning combination, the slot machine 1 awards a payout in accordance with this combination and the credit amount (bet amount) thus bet.

In the present invention, the number of reels is not limited to four reels. Specifically, the number of reels in the slot machine 1 can be changed to a different number.

Figure 4:
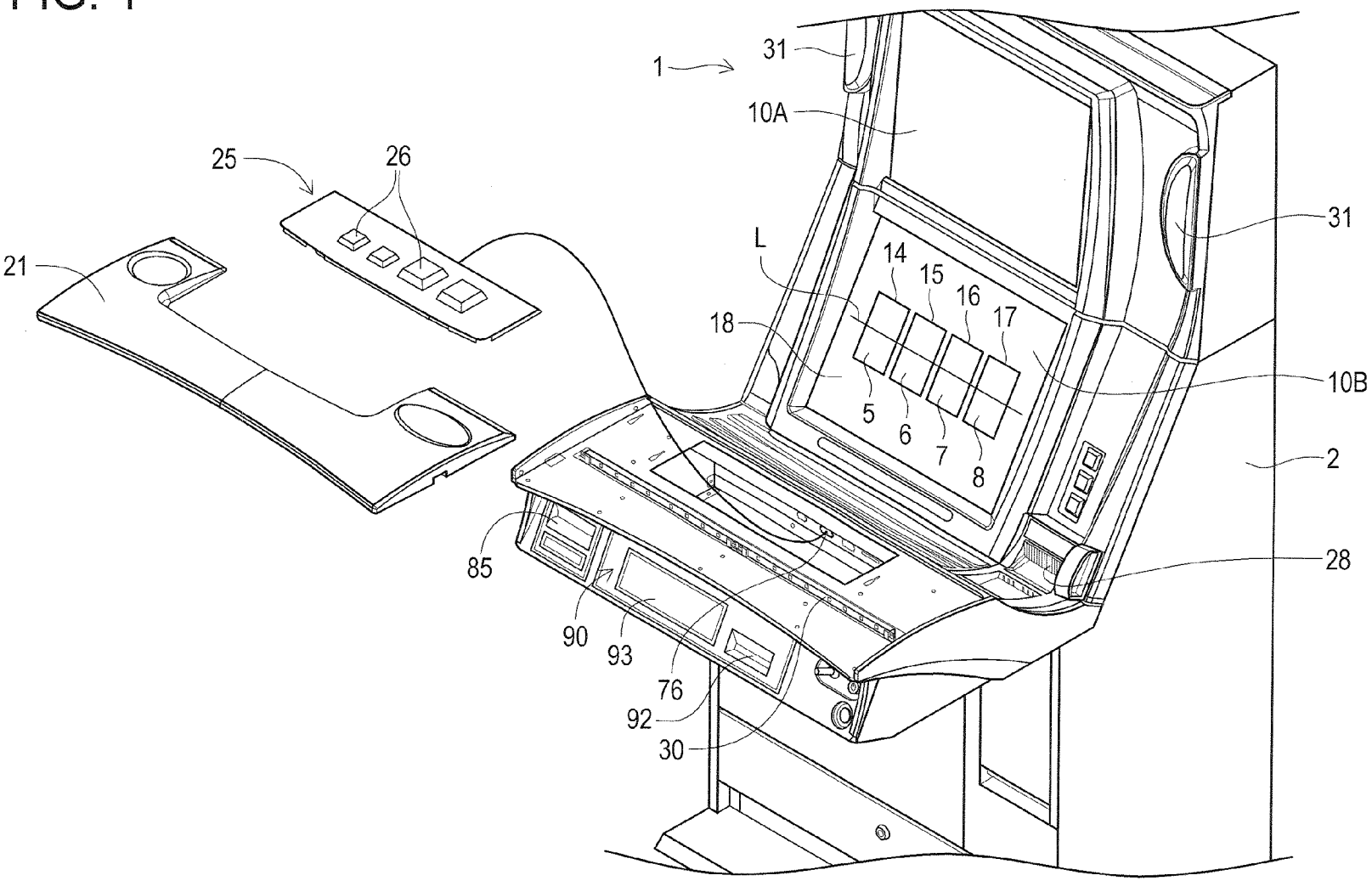
FIG. 4 is an explanatory diagram illustrating an example of connection with respect to a relay board according to the first embodiment of the present invention.

Further, a touch panel 18 is provided at a front face of the main display 10B (refer to FIG. 2 and FIG. 4). Accordingly, the player can operate the touch panel 18 to input various types of commands. For instance, the players can select a desired selection from a plurality of selections which are displayed on the main display 10B, by depressing the touch panel 18 with a finger.

A luminescent device 30 is arranged at a peripheral edge of the upper display 10A and a peripheral edge of the main display 10B. A similar luminescent device 30 is arranged at the armrest 20 (refer to FIG. 4). These luminescent devices 30 light up in a predetermined lighting fashion in case predetermined conditions are satisfied (for instance, at the time of winning).

A bill slot 28 is formed at a front face of the cabinet 2. The bill slot 28 is adapted to accept bills inside the cabinet 2. At the slot machine 1, the player can insert a predetermined ticket in the bill slot 28. Such a ticket is output from the ticket printer 85 as will be described later. This ticket includes information with respect to the amount of gaming values awarded to the player based on the game results. Specifically, the slot machine 1 can identify the amount of gaming values which can be used in the game based on the gaming value amount information included in such a ticket.

In the slot machine 1 according to the first embodiment, bills, tickets or electronic valuable information (credits) corresponding to these can be used as gaming values. The gaming values applicable to this invention are not limited to these. For instance, coins, medals, tokens, electronic money, tickets or the like can also be employed.

As shown in FIG. 2 and so on, the slot machine 1 has speakers 31. The speakers 31 are arranged in the front face of the cabinet 2. The speakers 31 are arranged respectively on left and right sides of the upper display 10A. The speakers 31 output sounds according to the progress of the game. These speakers 31 are so-called full-range speakers. A full-range speaker is a speaker designed to cover the whole human auditory range (approximately 20 Hz through 20 kHz) with one speaker. However, the full-range speaker has limits thereof with respect to the reproducible frequency range. Accordingly, there is a problem in a full-range speaker that the sound output thereof is not sufficient enough in some part of low-pitch range and some part of high-pitch range.

As mentioned above, the slot machine 1 has the armrest 20. The armrest 20 is formed so as to protrude in the direction of the player (in other words, frontward of the slot machine 1) from the front face of the cabinet 2. The armrest 20 is formed below the main display 10B. While taking a seat in front of the slot machine 1, a player can play a game with his/her arm(s) rested on the armrest 20. Here, the arm(s) rested on the armrest 20 are positioned higher than the lower end of the above-mentioned main display 10B.

The armrest 20 has an upper panel 21, a control panel 25, a woofer 80, a ticket printer 85 and a player-information acquisition device 90. The upper panel 21 is a portion which comes into contact with the arm(s), etc. of a player. The upper panel 21 is positioned higher than the lower end portion of the main display 10B (refer to FIG. 2 and FIG. 4). Accordingly, when the player puts his/her arm(s) on the upper panel 21, he/she looks down the main display 10B from a higher point. The control panel 25 has a plurality of operation buttons 26. The plurality of operation buttons 26 include a BET button, a collect button, a start button, a CASHOUT button, and so on. The control panel 25 is used by a player to carry out operations in a game. The woofer 80 is a speaker specialized in low-pitched sound output. The ticket printer 85 outputs, onto a ticket, the amount of gaming values that the player possesses when terminating a game in the slot machine 1. The player-information acquisition device 90 displays the game-related information concerning the player (hereinafter referred to as player-information). The player-information acquisition device 90 is also called a PTS (Player Tracking System). The player-information includes a piece of information showing the history of game results. The armrest 20 will later be explained in detail with reference to the drawings.

Figure 3:
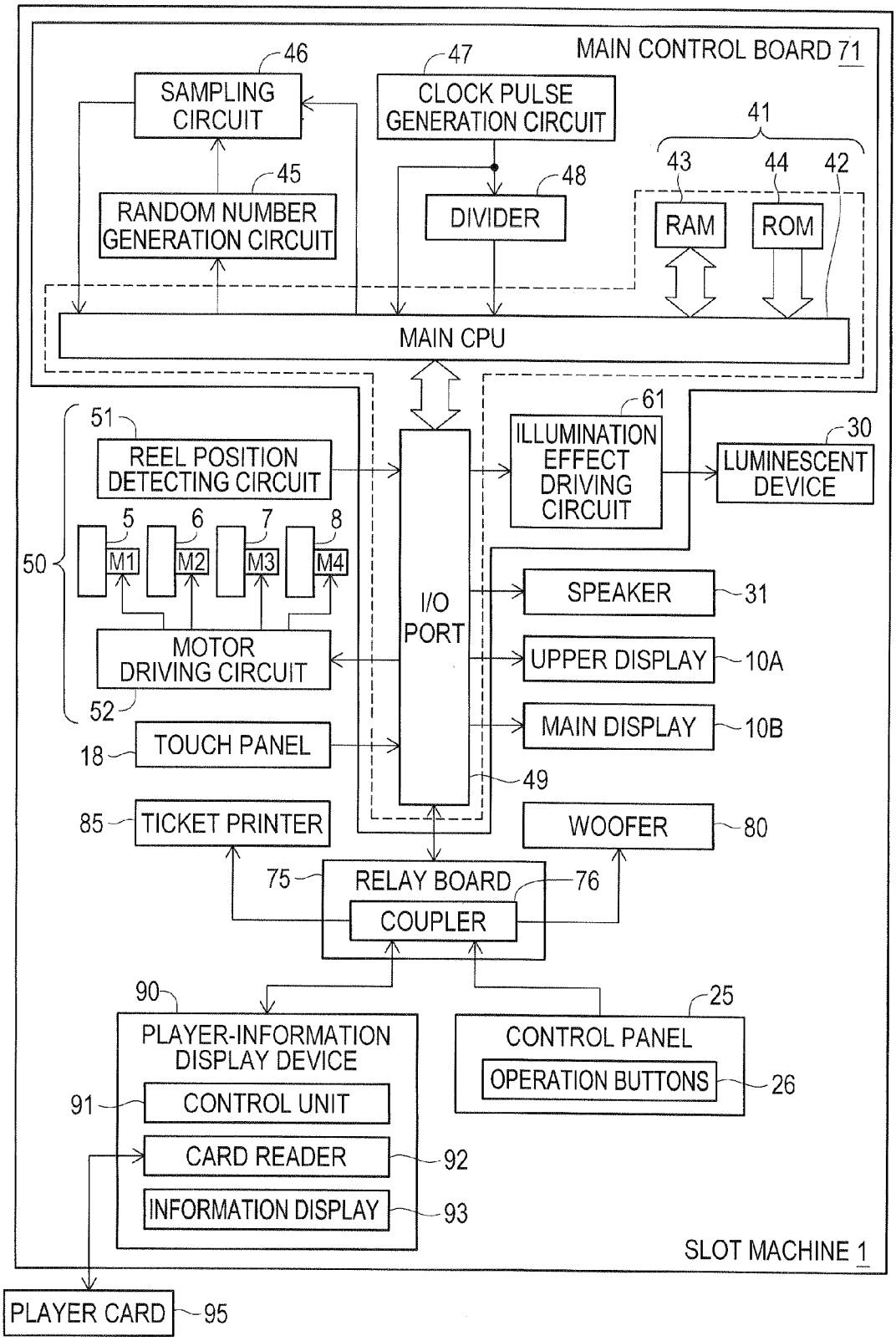
FIG. 3 is a block diagram illustrating an internal configuration of the slot machine according to the first embodiment of the present invention.

Next, an internal configuration of the slot machine 1 will be explained with reference to the drawings. FIG. 3 is a block diagram illustrating an internal configuration of the slot machine 1. As shown in FIG. 3, the slot machine 1 includes a plurality of components with a main control board 71 as the main component thereof. The main control board 71 includes a controller 41 for executing control programs.

The controller 41 includes a main CPU 42, a RAM 43 and a ROM 44. The main CPU 32 inputs and outputs signals to and from other components via an I/O port 49 to carry out programs stored in the ROM 44. Accordingly, the main CPU 42 works as the center of control with respect to the slot machine 1. The RAM 43 temporarily stores data or programs to be used during an operation of the main CPU 42. For instance, random numbers which are sampled by the after-mentioned sampling circuit 46 are stored temporarily in the RAM 43. The ROM 44 stores programs executed by the main CPU 42 and static data.

The controller 41 executes control with respect to the sound output in the slot machine 1. That is, the controller 41 controls the speakers 31 and the woofer 80. The controller 41 executes control with respect to the contents displayed in the upper display 10A and the main display 10B.

Specifically, the programs stored in the ROM 44 include game programs and game system programs (hereinafter referred to as "game programs, etc."). A lottery program is also included in the game programs.

The lottery program is a program used to determine the code number of each reel, the first reel 5 through the fourth reel 8. The code number corresponds to each symbol rearranged on the payline L. The lottery program includes symbol weighing data. The symbol weighing data correspond to plural kinds of payout rates (for instance, 80%, 84% and 88%), respectively. The symbol weighing data are the data indicating correlation between the code number of each of the reels, the first reel 5 through the fourth reel 8, and one or plural random numbers within a predetermined number range (for instance, 0 to 255).

The main control board 71 includes a random number generation circuit 45, a sampling circuit 46, a clock pulse generation circuit 47 and a divider 48, along with the controller 41. The random number generation circuit 45 is operated according to the commands from the main CPU 42, and generates random numbers within a predetermined range. The sampling circuit 46 arbitrarily extracts random numbers from the random numbers generated by the random number generation circuit 45 in accordance with the commands from the main CPU 42. The sampling circuit 46 inputs the extracted random numbers to the main CPU 42. The clock pulse generation circuit 47 generates a base clock for the operation of the main CPU 42. The divider 48 inputs to the main CPU 42 the signals which are generated by dividing the base clock in a predetermined frequency.

A reel driving unit 50 is connected to the main control board 71. The reel driving unit 50 includes a reel position detecting circuit 51 and a motor driving circuit 52. The reel position detecting circuit 51 detects the stopped positions of the first reel 5, the second reel 6, the third reel 7 and the fourth reel 8, respectively. The motor driving circuit 52 inputs driving signals to a first motor M1, a second motor M2, a third motor M3 and a fourth motor M4. The first motor M1 through the fourth motor M4 are respectively connected to the first reel 5 through the fourth reel 8. The first motor M1 through the fourth motor M4 are operated based on the input of driving signals from the motor driving circuit 52. Accordingly, the first reel 5 through the fourth reel 8 are rotated and stopped at a desired position respectively by the first motor M1 through the fourth motor M4.

Furthermore, the touch panel 18 is connected to the main control board 71. The touch panel 18 specifies the coordinate position of the portion touched by a player. The touch panel 18 determines the position on which the player touched and the direction of the movement of the touched portion based on the information of the specified coordinate position. The signals corresponding to the determination are input to the main CPU 42 through the I/O port 49.

The main control board 71 also includes an illumination effect driving circuit 61. The illumination effect driving circuit 61 outputs an effect signal to the above-mentioned luminescent device 30. When the effect signal is input, the luminescent device 30 is illuminated in a predetermined illuminating fashion. As a result, the slot machine 1 executes effects in accordance with the game progress.

The main control board 71 is connected to the upper display 10A, the main display 10B and the speakers 31, respectively. The controller 41 transmits control signals to the upper display 10A, the main display 10B and the speakers 31 based on the game program. As mentioned above, the speakers 31 output sounds according to the progress of the game based on a control signal output from the controller 41. The upper display 10A and the main display 10B display various kinds of information based on control signals which are output from the controller 41.

The main control board 71 is connected to a relay board 75. The relay board 75 has a coupler 76 (refer to FIG. 3 and FIG. 4). Through the coupler 76, the relay board 75 is connected to the control panel 25, the woofer 80, the ticket printer 85, and the player-information acquisition device 90. The control signal output from the controller 41 is input through the relay board 75 to the peripherals (specifically, the woofer 80, the ticket printer 85 and the player-information acquisition device 90) which are connected to the relay board 75. Also, the relay board 75 inputs to the controller 41 a signal from a peripheral connected through the coupler 76.

The relay board 75 has a control unit (not shown). The control unit executes control with respect to the input/output of a signal between the controller 41 and each of the peripherals connected to the relay board 75. For instance, when a control signal is input from the controller 41, the control unit specifies a peripheral which is the target of the control signal. Then, the control unit inputs the control signal to the specified peripheral.

As shown in FIG. 3 and FIG. 4, the control panel 25 is connected to the controller 41 through the coupler 76 and the relay board 75. The control panel 25 has operation buttons 26. The operation buttons 26 include a start button for instructing execution of a game, a collect button, a BET button and so on. Upon being held down, each button included in the operation buttons 26 inputs an operation signal to the controller 41 through the coupler 76 and the relay board 75.

The woofer 80 is connected to the controller 41 through the coupler 76 and the relay board 75. As mentioned above, the woofer 80 is a speaker specialized in the sound output which corresponds to the low-pitch range of the human auditory range. The control signal which is output from the controller 41 is input to the woofer 80 through the relay board 75 and the coupler 76. The woofer 80 outputs the sounds corresponding to the low-pitch range based on the control signal currently input. Therefore, the woofer 80 can output sounds corresponding to the low-pitch range according to the progress of the game.

In other words, the woofer 80 outputs low-pitched sounds which can not be appropriately output at the speakers 31. Specifically, the slot machine 1 can execute an audio effect with high-quality sounds by using the speakers 31 which are full range speakers and the woofer 80 in combination. As a result, the slot machine 1 can stimulate the player's interest in the game by executing the audio effect with high-quality sounds.

The ticket printer 85 is connected to the controller 41 through the coupler 76 and the relay board 75. The ticket printer 85 outputs a ticket which contains information indicating the amount of gaming values. For instance, when ending a game, the controller 41 inputs, to the ticket printer 85, information indicating the amount of the gaming value which the player possesses and a control signal through the relay board 75 and the coupler 76. In this case, in response to the control signal, the ticket printer 85 can print out a ticket containing information indicating the amount of the gaming value.

A player-information acquisition device 90 is connected to the controller 41 through the coupler 76 and the relay board 75. The player-information acquisition device 90 is called a PTS (Player Tracking System). The player-information acquisition device 90 has a control unit 91, a card reader 92 and an information display 93. The player-information acquisition device 90 reads out the player-information stored in a player-card 95 from this player-card 95 through the card reader 92. The player-information acquisition device 90 displays the player-information in the information display 93. Thus, the player-information acquisition device 90 can notify the player of his/her own player-information (for instance, his/her personal history of game results).

The control unit 91 takes charge of the control of the whole player-information acquisition device 90. Specifically, the control unit 91 controls the card reader 92 and the information display 93 based on a control signal output from the controller 41.

The card reader 92 reads out the player-information which is stored in the player-card 95, in accordance with the control of control unit 91. Also, the card reader 92 can also write predetermined kinds of information (for instance, information on a history of game results) in the player-card 95, in accordance with the control of the control unit 91. The player-card 95 is a card which the player possesses on an individual basis. The player-card 95 incorporates a storage medium therein which can store various kinds of information with respect to a game.

The information display 93 displays the player-information read out from the player-card 95. The information display 93 displays the player-information in accordance with the control of the control unit 91. The player can confirm his/her own player-information by seeing the displayed contents on the information display 93.

Here, the relay board 75 is arranged inside the cabinet 2, in the proximity of the lower end portion of the main display 10B. Then, the coupler 76 of the relay board 75 faces the inside of the armrest 20. As shown in FIG. 4, the control panel 25 is connected to the relay board 75 through the coupler 76 which faces inside the armrest 20. The coupler 76 is also called a connector. By using a hand or a simple tool, the coupler 76 can be easily attached or removed. In other words, the control panel 25 can be easily attached onto or removed from the relay board 75 with a hand of an operator and so on. Therefore, even in a case where a control panel needs changing due to a model change (for instance, change of game contents) and so on, according to the present slot machine 1, the operator can carry out the replacement of the control panel quite easily.

The control panel 25 is one example of the peripherals connected to the relay board 75 through the coupler 76. As mentioned above, the woofer 80, the ticket printer 85 and the player-information acquisition device 90 are also connected to the relay board 75 through the coupler 76 (refer to FIG. 3). Accordingly, the woofer 80, the ticket printer 85 and the player-information acquisition device 90 can also be easily removed from or attached onto the relay board 75 with the hand of the operator and so on.

The coupler 76 of the relay board 75 faces the inside of the armrest 20. That is, in a case of removal/attachment work with respect to the peripherals arranged in the armrest 20 from/onto the relay board 75, an operator can complete the work without accessing the inside of the cabinet 2. In other words, this slot machine 1 can reduce the number of times to access the main control board 71 which is arranged inside the cabinet 2. As a result, it becomes possible for this slot machine 1 to prevent a fraudulent modification to the main portion including the main control board 71.

Next, the woofer 80 arranged in the armrest 20 is described in detail with reference to the drawings. As mentioned above, the woofer 80 is a speaker specialized in the sound output corresponding to the low-pitch range in the human auditory range.

As shown in FIG. 5, the woofer 80 has an enclosure 81, a diaphragm 82 and a drive unit 83. The enclosure 81 is a casing which houses the diaphragm 82 and the drive unit 83. The enclosure 81 can insulate sounds from the rear of the diaphragm 82 and the drive unit 83, preventing the interference thereof in sounds coming from the front of the diaphragm 82. The drive unit 83 has a voice coil and a permanent magnet. This drive unit 83 drives according to a control signal which is input through the relay board 75. The diaphragm 82 is secured to the opening edge of the enclosure 81 and to the drive unit 83. The drive of the drive unit 83 vibrates the diaphragm 82. That is, through vibrating the diaphragm 82 in response to the control signal, the woofer 80 vibrates air and outputs low-pitched sounds.

At the woofer 80, the vibration system (for instance, diaphragm 82 and drive unit 83) has a large stroke. The gauge of the woofer 80 is larger than those of full-range speakers such as the speakers 31. As a result, the woofer 80 can output sounds with reduced distortion in a high sound pressure level. That is, the woofer 80 can output powerful sounds in the low-pitch range.

The woofer 80 is arranged at the bottom surface of the armrest 20 (refer to FIG. 5). The woofer 80 vibrates the diaphragm 82 and the drive unit 83 when outputting low-pitched sounds. Therefore, vibrations produced in the woofer 80 are transmitted to the armrest 20.

Here, the slot machine 1 is a slanted-type slot machine. Therefore, the player puts his/her arm(s) (for instance, elbow(s), etc.) on the upper surface of the armrest 20 (for instance, on the upper panel 21) when playing a game. In the slot machine 1, the control panel 25 is arranged in an area nearer to the cabinet 2, on the upper surface of the armrest 20 (refer to FIG. 1 and FIG. 4). Accordingly, when the player operates the operation buttons 26, the arm(s) of the player are put on the armrest 20, as a matter of course. As a result, when outputting low-pitched sounds, vibrations produced in the woofer 80 are transmitted through the armrest 20 to the arm(s) of the player.

The woofer 80 stimulates the player's interest in the game through outputting the low-pitched sounds in accordance with the progress of the game. As above mentioned, the player senses the vibrations produced in the woofer 80 through the armrest 20 when the low-pitched sounds are output. As a result, the slot machine 1 can execute an effect by the vibrations of the armrest 20 simultaneously with an effect by the sound output of the speakers 31 and the woofer 80. In other words, the slot machine 1 can further stimulate the player's interest in the game by the audio effect and the vibration effect.

The woofer 80 is arranged at the bottom surface of the armrest 20. As shown in FIG. 1 and FIG. 5, an opening where the sounds from the woofer 80 are output is formed at the bottom surface of the armrest 20. In other words, the opening of the enclosure 81 is positioned on the underside of the armrest 20. The diaphragm 82 of the woofer 80 is positioned lower than the enclosure 81 and the drive unit 83. Here, the sounds which are output by the woofer 80 has the directivity in a downward direction.

Here, the use of the armrest 20 is not limited to resting the arm(s) of the player. For instance, the player can also put a drink, etc., on the armrest 20. If a drink is put on the armrest 20, the player may accidentally spill the drink thereon. In such a case, the spilt drink may enter inside of the armrest 20. This means that the spilt drink may cause a malfunction of the peripherals (e.g. woofer 80) arranged in the armrest 20, caused by the short circuit, etc.

However, in the slot machine 1, the woofer 80 is arranged inside the armrest 20 in the condition that the directivity with respect to the sound output thereof is in the downward direction. That is, the opening of the woofer 80 is formed on the bottom surface of the armrest 20 (refer to FIG. 1 and FIG. 5). Therefore, even in the case of spilling a drink, etc. over the armrest 20, the drink will never enter inside the armrest 20 through the opening of the woofer 80. In other words, the slot machine 1 can prevent a malfunction due to a short circuit etc. with respect to the peripherals arranged inside the armrest 20. The slot machine 1 can specifically prevent a malfunction of the woofer 80 arranged inside the armrest 20, because the drink will never reach the woofer 80 through the opening.

As explained above, the slot machine 1 directed to the first embodiment has the woofer 80 inside the armrest 20 where the player's arm(s) etc. are to be rested. The woofer 80 is a speaker specialized in the sound output in the low-pitch range, complementing the speakers 31 by outputting sounds in a range which the speakers 31 cannot output appropriately. When outputting low-pitched sounds, the woofer 80 vibrates and transmits the vibrations to the armrest 20. In the slot machine 1, the player operates the control panel 25 while resting his/her arm(s) etc. on the armrest 20. Accordingly, the vibrations produced in the woofer 80 are transmitted to the player through the armrest 20. As a result, the slot machine 1 can execute an effect by the vibrations of the armrest 20 simultaneously with an effect by the sound output of the speakers 31 and the woofer 80. Accordingly, the slot machine 1 can further stimulate the player's interest in the game by the audio effect and the vibration effect.

Also, in the slot machine 1, the woofer 80 is connected to the controller 41 through the coupler 76 and the relay board 75. The relay board 75 is arranged inside the cabinet 2. Then, the coupler 76 arranged on the relay board 75 is arranged facing the inside of the armrest 20 (refer to FIG. 4). In other words, according to the slot machine 1, an operator can carry out maintenance work to the woofer 80 without accessing the inside of the cabinet 2. Accordingly, the slot machine 1 can prevent a fraudulent modification to the main control board 71 etc. inside the cabinet 2 through reducing the number of times to access the inside of the cabinet 2. Also, because the coupler 76 can be removed or attached easily by hand, the slot machine 1 can reduce the load of the operator to the replacement work of a woofer.

In the slot machine 1, the woofer 80 is arranged at the bottom surface of the armrest 20 in the condition that the directivity of the sound output thereof is in the downward direction of the armrest 20 (refer to FIG. 1 and FIG. 5). That is, the opening of the woofer 80 is formed on the bottom surface of the armrest 20. As a result, the slot machine 1 can prevent a malfunction of the woofer 80 caused by liquids (e.g. a drink and so on) spilt onto a diaphragm etc.

The present invention is not limited to the above-described embodiment, and it is obvious that various improvements and modifications can be made thereto without departing from the spirit of the present invention. For instance, this invention is not limited to a slot machine having four reels. This invention can be adopted in various gaming machines if a woofer 80 is provided inside an armrest 20 thereof. For instance, this invention can be applied to a video slot machine and a card game machine.

The types of speakers used for the gaming machine according to the present invention are also not limited to those described in the above-described embodiment. Various embodiments can be adopted in the gaming machine according to this invention if a woofer is included therein. For instance, an embodiment can also be adopted in which a tweeter is added to the speakers 31 (i.e. full range speakers) and the woofer as above mentioned. The tweeter is a speaker specialized in the sound output in the high-pitch range. The gaming machine according to the present invention can be realized using squawkers in place of the speakers 31. A squawker is a speaker specialized in the midrange sound output.

Moreover, in the gaming machine according to the present invention, an embodiment can also be adopted in which a sub woofer is added to the speakers 31 and the woofer 80 as above mentioned. The sub woofer is a speaker specialized in the sound output of the further lower-pitch range than the woofer 80. In such a case, it is preferable that the sub woofer is arranged inside the armrest 20, similar to the woofer 80.

[Second Embodiment]

A gaming machine according to the second embodiment will be described in detail with reference to the drawings as embodied in a slot machine 101.

The features of the slot machine 101 according to the second embodiment will be described in detail with reference to the drawings. The slot machine 101 according to the second embodiment is a so-called hybrid-type slot machine. This hybrid-type slot machine has a known transmissive liquid crystal panel arranged in front of a plurality of mechanical reels. The plurality of mechanical reels are rotatably supported. This hybrid-type slot machine turns the transmissive liquid crystal panel into a transparent state when executing a game so as to allow the images of various symbols depicted on the outer peripheral surface of the mechanical reels to be displayed.

Figure 6:
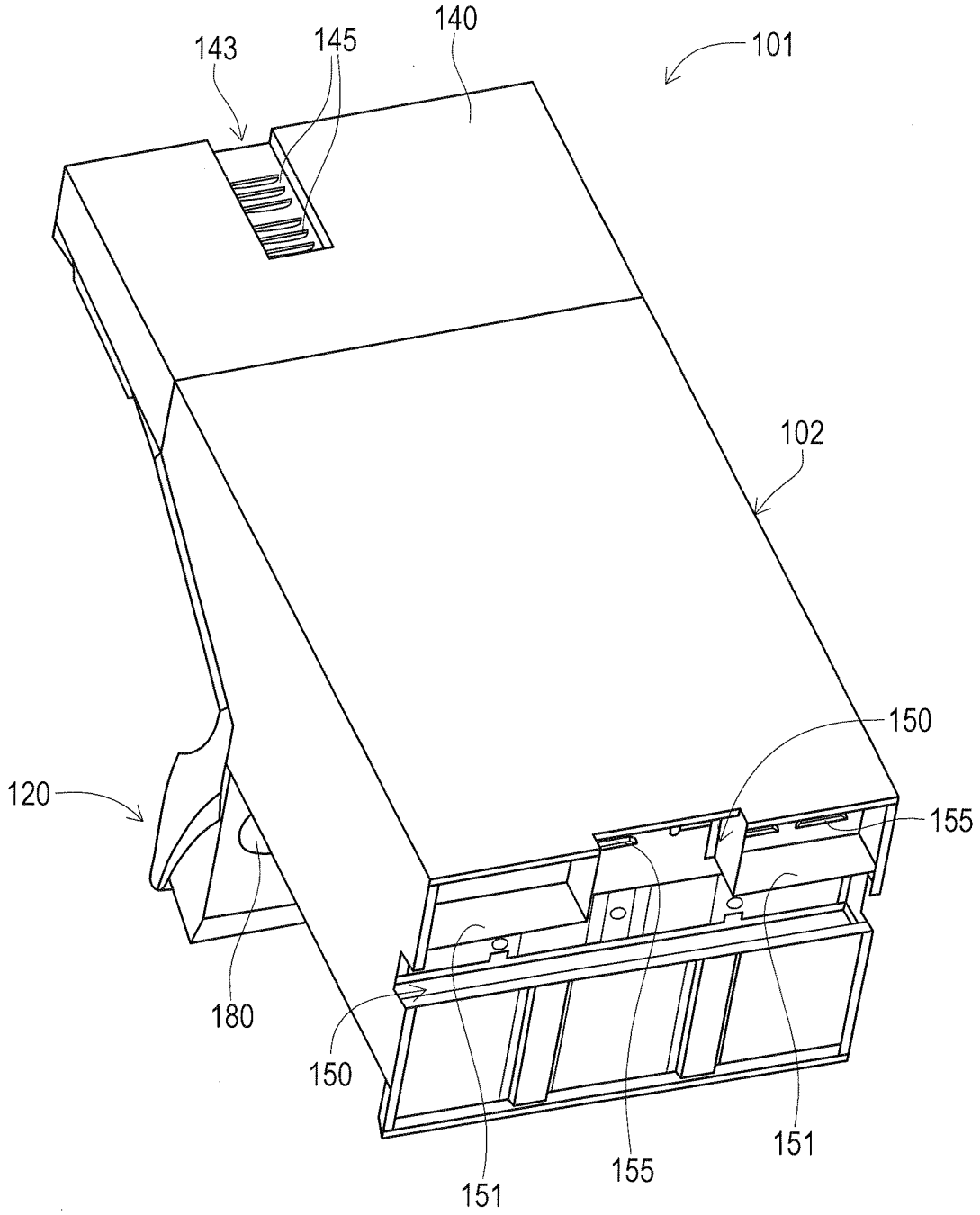
FIG. 6 is an explanatory diagram illustrating a feature of a slot machine according to the second embodiment of the present invention.
Figure 7:
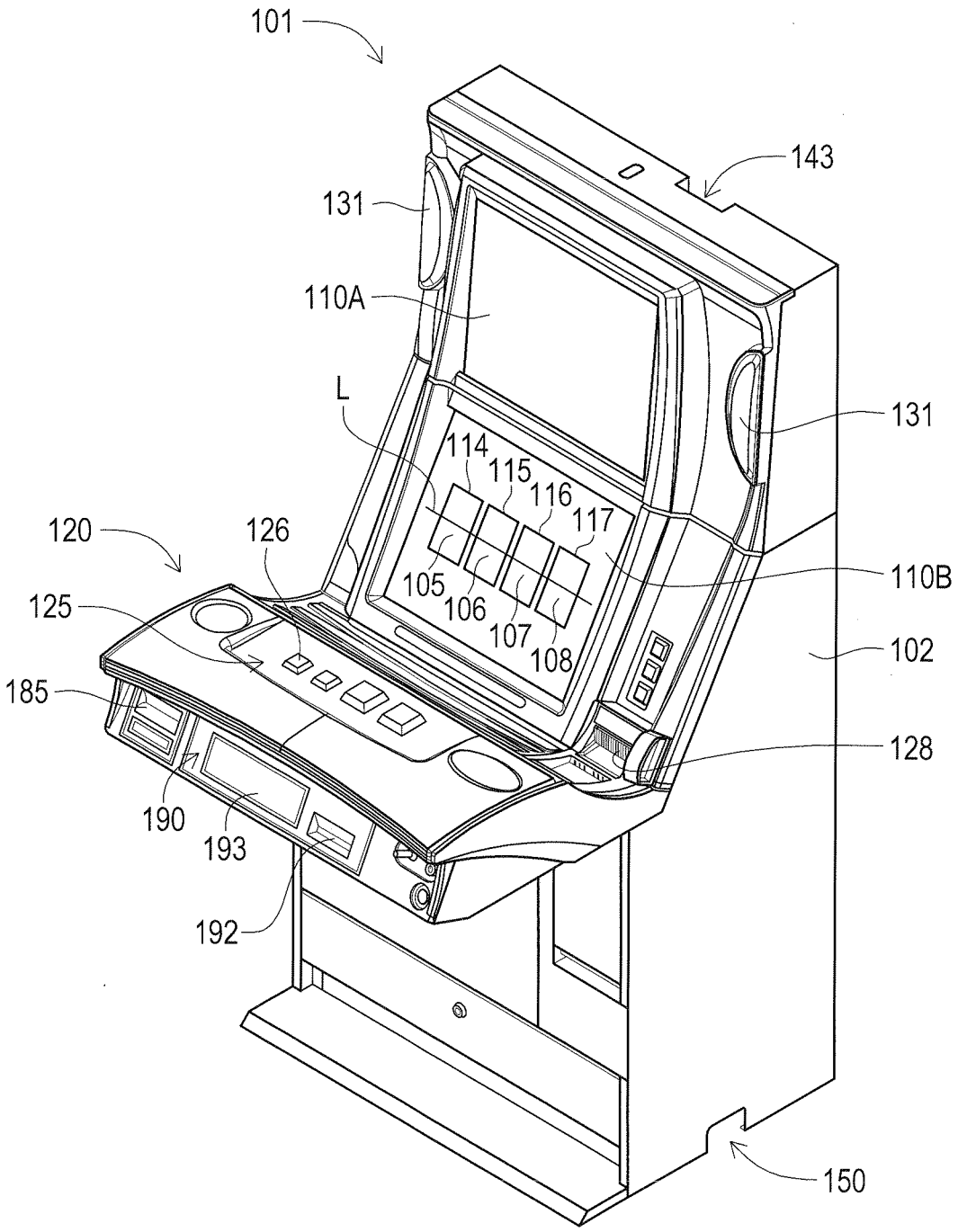
FIG. 7 is a perspective view illustrating an outer appearance of the slot machine according to the second embodiment of the present invention.

Also, the slot machine 101 is a slanted-type slot machine as is installed in game arcades such as casinos (refer to FIG. 6 and FIG. 7). In case of the slanted-type slot machine, the player plays a game while sitting on a seat arranged in front of the slot machine.

Here, the slot machine 101 according to the second embodiment has a cabinet 102. The cabinet 102 houses electrical and mechanical components for executing predetermined game aspects in the slot machine 101. The electrical and mechanical components include reels and a control board 170, which will be described later. For instance, the control board 170 to be described later is housed in the lower portion of the cabinet 102 (refer to FIG. 10). The cabinet 102 has a back panel 140. The back panel 140 constitutes the back face of the cabinet 102.

The back panel 140 has a recess portion 143 which recesses in a predetermined length from the back panel 140. Further, the recess portion 143 has a plurality of exhaust holes 145 (six exhaust holes in the second embodiment). The exhaust holes 145 each communicate with the inside of the cabinet 102 (refer to FIG. 10). The slot machine 101 has two exhaust fans 135. The exhaust fans 135 are arranged in the proximity of the exhaust holes 145 inside the cabinet 102. Accordingly, the slot machine 101 can exhaust air inside the cabinet 102 through the exhaust holes 145 by driving the exhaust fans 135.

Further, the recess portion 43 extends to the upper surface of the cabinet 102. This allows the recess portion 143 to guide the air exhausted from the exhaust holes 145 to the upper side of the cabinet 102. Therefore, even when the slot machine 101 is arranged with its back face in contact with a wall surface (for instance, a wall surface of a game arcade or a back face of other gaming machine), the air exhausted from the exhaust holes 145 is exhausted upward of the slot machine 101. Accordingly, it is possible to reduce a space for exhausting air in the cabinet 102 of the slot machine 101. As a result, the slot machine 101 can contribute to effective use of spaces in game arcades.

Figure 10:
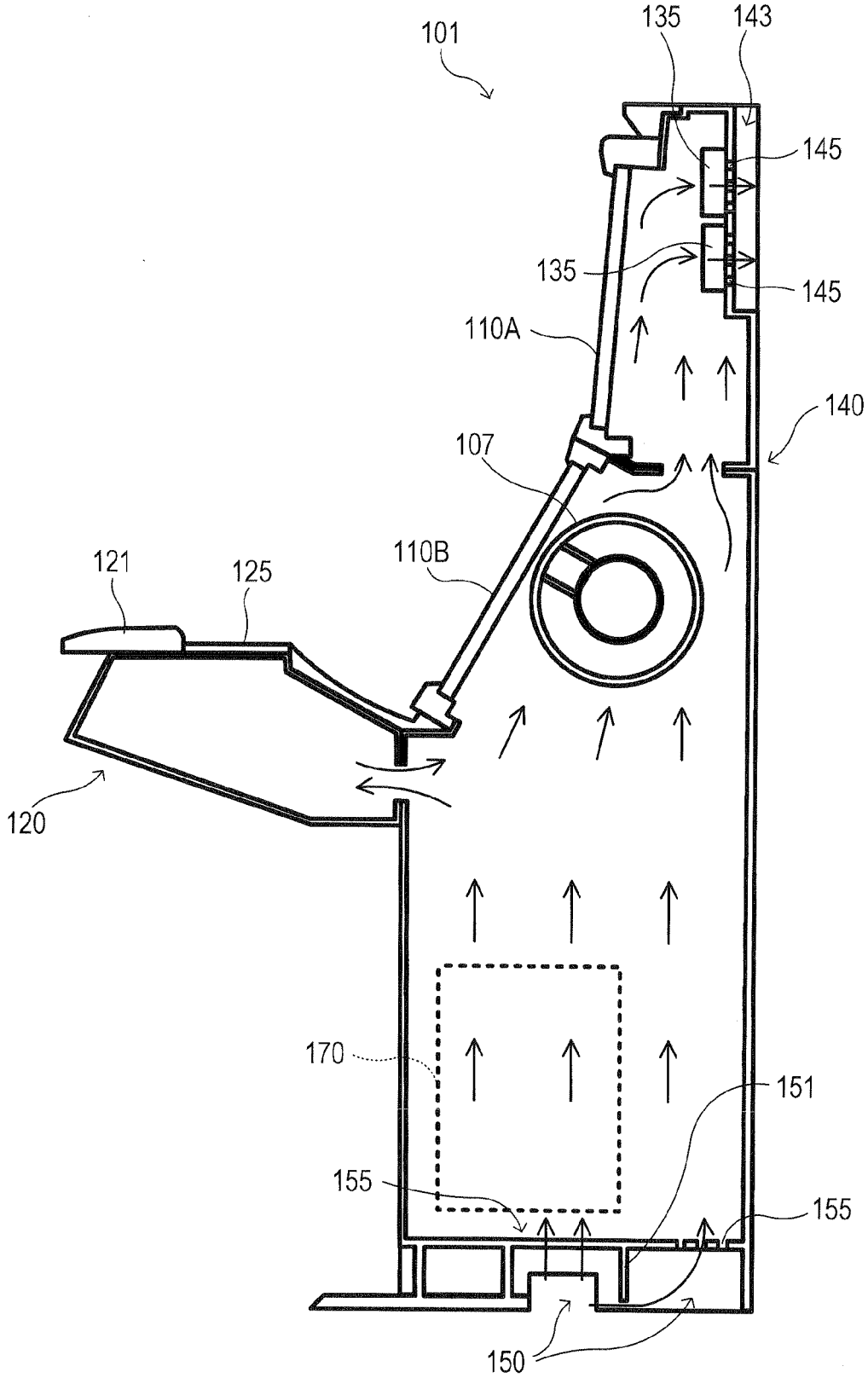
FIG. 10 is an explanatory diagram illustrating circulation of air in the slot machine according to the second embodiment of the present invention.

Further, as shown in FIG. 6, the slot machine 101 has an intake passage 150 at the bottom surface of the cabinet 102. The intake passage 150 provides communication among the back, left and right side surfaces of the cabinet 102 (refer to FIG. 6). The intake passage 150 has a plurality of intake holes 155. The intake holes 155 provide communication between the outside and inside of the cabinet 102. Accordingly, the slot machine 101 can introduce the air outside the cabinet 102 from the bottom surface through the inside of the cabinet 102. Further, as shown in FIG. 10, the air taken in from the intake holes 155 moves inside the cabinet 102 from the lower side to the upper side, and is then exhausted from the exhaust holes 145. Therefore, the slot machine 101 can cool down the components arranged inside the cabinet 102 (such as the control board 170). As a result, the slot machine 101 can cool down the components arranged inside the cabinet 102, thereby preventing a malfunction due to the heat generated by the components.

Next, the slot machine 101 according to the second embodiment will be described in detail with reference to the drawings. FIG. 7 is a perspective view illustrating an outer appearance of the slot machine 101 according to the second embodiment.

As shown in FIG. 7, the slot machine 101 has a cabinet 102. The cabinet 102 has built-in components. The components include a control board 170, a motor as a rotation drive device for each reel, and the like. The control board 170 works as the center of control with respect to the slot machine 101.

Further, as shown in FIG. 10, the exhaust fans 135 are arranged inside the cabinet 102. The exhaust fans 135 work as an air blower. The exhaust fans 135 exhaust the air inside the cabinet 102 to the outside.

Here, the components housed in the cabinet 102 perform predetermined operations in accordance with operational status of the slot machine 101. This causes each component to generate heat, so that the air inside the cabinet 102 is heated. When the air inside the cabinet 102 is heated, the components (for instance, controllers and the like including a CPU) may cause a malfunction in accordance with the condition of temperature. The exhaust fans 135 can prevent such a malfunction by exhausting the heated air in the cabinet 102.

Four reels (specifically, a first reel 105, a second reel 106, a third reel 107 and a fourth reel 108) are provided inside the cabinet 102 in a freely rotating fashion. The first reel 105 through the fourth reel 108 each have a symbol string drawn on an outer peripheral surface thereof. Each symbol string is made up of a predetermined number of symbols. Also, each symbol string includes a plurality of types of symbols.

The cabinet 102 has an upper display 110A and a main display 110E provided at a front face thereof. The upper display 110A is arranged at an upper front portion of the cabinet 102. The upper display 110A is made up of a heretofore known liquid crystal panel. The upper display 110A displays information with respect to the game. The display contents to be displayed on the upper display 110A include effect images, introduction of the game contents, game rule explanations and the like.

The main display 110B is arranged at a middle front of the cabinet 102. The main display 110B is made up of a heretofore known transmissive liquid crystal panel or the like. The main display 110B displays information with respect to the game. Specifically, the player progresses the game in the slot machine 101 based on the display of the main display 110B.

The main display 110B has a first display window 114, a second display window 115, a third display window 116 and a fourth display window 117. As described earlier, the first reel 105 through the fourth reel 108 are arranged inside the cabinet 102. The main display 110B is positioned in front of the first reel 105 through the fourth reel 108. In the main display 110B, the first display window 114 through the fourth display window 117 are formed at portions corresponding to the first reel 105 through the fourth reel 108. For instance, the first display window 114 is formed at a position corresponding to the front of the first reel 105 of the main display 110B. In the slot machine 101, the inner side of the first display window 114 through the fourth display window 117 can be changed to a transparent state. This enables players to view behind the main display 110B through the first display window 114 through the fourth display window 117. Specifically, the players can see the symbols drawn on the first reel 105 through the fourth reel 108 through the first display window 114 through the fourth display window 117.

The main display 110B displays one pay line L (refer to FIG. 7). The pay line L crosses the center of the first display window 114 through the fourth display window 117 in a horizontal fashion. The pay line L defines a symbol combination constituting the game results. Accordingly, if the symbol combination which has been repositioned on the pay line L is a predetermined winning combination, the slot machine 101 awards a payout in accordance with this combination and the credit amount (bet amount) thus bet.

In the present invention, the number of reels is not limited to four reels. Specifically, the number of reels in the slot machine 101 can be changed to a different number.

Further, a touch panel 118 is provided at a front face of the main display 110B (refer to FIG. 7). Accordingly, the player can operate the touch panel 118 to input various types of commands. For instance, the players can select a desired selection from a plurality of selections which are displayed on the main display 110B, by depressing the touch panel 118 with a finger.

A bill slot 128 is formed at a front face of the cabinet 102. The bill slot 128 is adapted to accept bills inside the cabinet 102. At the slot machine 101, the player can insert a predetermined ticket in the bill slot 128. Such a ticket is output from the ticket printer 185 as will be described later. This ticket includes information with respect to the amount of gaming values awarded to the player based on the game results. Specifically, the slot machine 101 can identify the amount of gaming values which can be used in the game based on the gaming value amount information included in such a ticket.

In the slot machine 101 according to the second embodiment, bills, tickets or electronic valuable information (credits) corresponding to these can be used as gaming values. The gaming values applicable to this invention are not limited to these. For instance, coins, medals, tokens, electronic money or the like can also be employed.

As shown in FIG. 7, the slot machine 101 has speakers 131. The speakers 131 are arranged in the front face of the cabinet 102. The speakers 131 are arranged respectively on left and right sides of the upper display 110A. The speakers 131 output sounds according to the progress of the game.

As mentioned above, the slot machine 101 has the armrest 120. The armrest 120 is formed so as to protrude in the direction of the player (in other words, frontward of the slot machine 101) from the front face of the cabinet 102. The armrest 120 is formed below the main display 110B. While taking a seat in front of the slot machine 101, a player can play a game with his/her arm(s) rested on the armrest 120. Here, the arm(s) rested on the armrest 120 are positioned higher than the lower end of the above-mentioned main display 110B.

The armrest 120 has an upper panel 121, a control panel 125, a woofer 180, a ticket printer 185 and a player-information acquisition device 190. The upper panel 121 is a portion which comes into contact with the arm(s), etc. of a player. The upper panel 121 is positioned higher than the lower end portion of the main display 110B (refer to FIG. 7 and FIG. 10). Accordingly, when the player puts his/her arm(s) on the upper panel 121, he/she looks down the main display 110B from a higher point. The control panel 125 is arranged in an area nearer to the main display 110B, on the upper surface of the armrest 120. The control panel 125 has a plurality of operation buttons 126. The plurality of operation buttons 126 include a BET button, a collect button, a start button, a CASH-OUT button, and so on. The control panel 125 is used by a player to carry out operations in a game. Accordingly, a player can operate the control panel 125 or the touch panel 118 while putting his/her arm(s) etc. on the upper panel 121.

The woofer 180 is arranged inside the armrest 120. The woofer 180 is a speaker specialized in low-pitched sound output. As shown in FIG. 6, the woofer 180 outputs low-pitched sounds in the downward direction from the armrest 120. When outputting low-pitched sounds, the woofer 180 vibrates largely due to the nature thereof. The vibrations generated in the woofer 180 are transmitted to the armrest 120. Accordingly, a player can sense the vibration through the armrest upon output of low-pitched sound.

The ticket printer 185, the player-information acquisition device 190 are arranged in the front face of the armrest 120. The ticket printer 185 outputs, onto a ticket, the amount of gaming values that the player possesses when terminating a game in the slot machine 101. As described above, the ticket output can be inserted into the bill slot 128. The player-information acquisition device 190 has a card reader 192 and an information display 193. The card reader 192 reads/writes data from/onto player-cards. The player-cards are memory media that memorize player-information. The player-information is information with respect to game-related information concerning the player who possesses the subject player card (for instance, history information on game results). The information display 193 displays the player-information read by the card reader 192. As a result, the player can confirm his/her own player-information by seeing the displayed contents of the information display 193. The player information acquisition device 190 is also called as a PTS (Player Tracking System).

Next, the configuration of the back side of the slot machine 101 according to the second embodiment will be explained in detail with reference to the drawings. As shown in FIG. 6, the slot machine 101 has the back panel 140 on the back side of the cabinet 102. The back panel 140 has the recess portion 143 in the upper side of the slot machine 101 (refer to FIG. 6 and FIG. 7).

The recess portion 143 has the plurality of exhaust holes 145. The exhaust holes 145 provide communication between the inside and the outside of the cabinet 102. Accordingly, the slot machine 101 can exhaust air inside the cabinet 102 through the exhaust holes 145 to the outside of the cabinet 102 (refer to FIG. 10). As shown in FIG. 10, the exhaust fans 135 are arranged in the proximity of the exhaust holes 145. The exhaust fans 135 forcibly exhaust the air inside the cabinet through the exhaust holes 145. Accordingly, the slot machine 101 can assuredly exhaust air inside the cabinet 102.

The surface where the exhaust holes 145 are formed (hereinafter, an exhaust-hole formation surface) is located at an inner side of the slot machine 101 compared to the other parts of the back panel 140 (refer to FIG. 6 and FIG. 8). Accordingly, even if the slot machine 101 is installed with its back surface in contact with a wall surface, the exhaust-hole formation surface will not be brought into contact with the wall surface. In other words, even in such a condition, the exhaust holes 145 will not be covered with the wall surface. As a result, even if the slot machine 101 is installed fitly on a wall surface, the slot machine 101 can smoothly exhaust air inside the cabinet to the outside.

Figure 8:
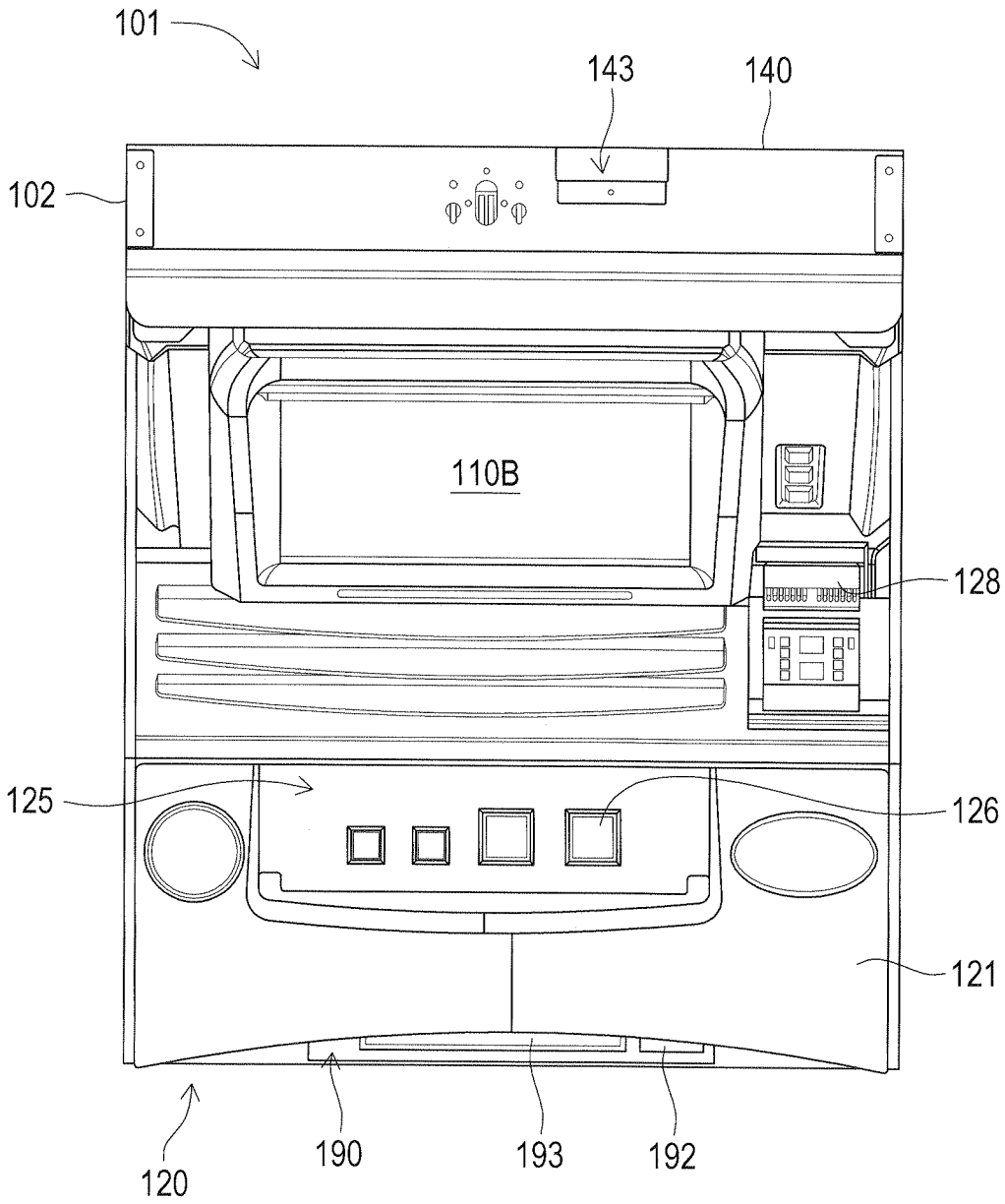
FIG. 8 is a plan view of the slot machine according to the second embodiment of the present invention.

The recess portion 143 communicates with the top surface of the cabinet 102 (refer to FIG. 6 through FIG. 8). Specifically, the recess portion 143 has an opening surface on each of the top side and the back side of the cabinet 102. Accordingly, when the slot machine 101 is installed with its back surface in contact with a wall surface, the air exhausted through the exhaust holes 145 is guided upward of the cabinet 102 through the recess portion 143 and the wall surface. In other words, even in such a condition, the slot machine 101 can smoothly exhaust air inside the cabinet 102 to the outside. As a result, the slot machine 101 can reduce an installation space required to exhaust air inside the cabinet (that is, a space at the back side of the slot machine 101). Therefore, the slot machine 101 can contribute to effective use of spaces in game arcades.

The recess portion 143 is formed at a position which deviates from the width-directional center of the back panel 140 in a predetermined direction (the right direction in FIG. 8). Accordingly, even when two slot machines 101 are arranged back to back, the recess portions 143 of the slot machines 101 will not face each other.

Here, consideration will be given on the case in which two slot machines 101 are arranged back to back and with their respective recess portions 143 positioned face to face. When the recess portions 143 are positioned face to face, the respective exhaust fans 143 of the recess portions 143 are also positioned face to face. Accordingly, the direction of exhaust air from the exhaust holes 145 of one slot machine 101 opposes to the direction of exhaust air from the exhaust holes 145 of the other slot machine 101. In other words, in this case, exhaust air of one slot machine 101 is obstructed by exhaust air of the other slot machine 101.

In the slot machine 101 according to the second embodiment, the recess portion 143 is formed on a position deviated to a predetermined direction (in FIG. 8, the right side) with respect to the width-directional center of the back panel 140. Owing to this, the exhaust holes 145 of one slot machine 101 are opposed to the back panel 140 of the other slot machine 101 and will not be opposed to the recess portion 143 and the exhaust holes 145 of the other slot machine 101. Accordingly, if the slot machines 101 according to the second embodiment are arranged back to back, exhaust air of one of the slot machines 101 will not obstruct exhaust air of the other one of the slot machines 101. As a result, the slot machine 101 according to the second embodiment makes it possible to smoothly exhaust air in the cabinet 102, even in a case that two slot machines 101 are arranged back to back. Furthermore, even in such a condition, the slot machine 101 can contribute to effective use of spaces in game arcades.

Figure 9:
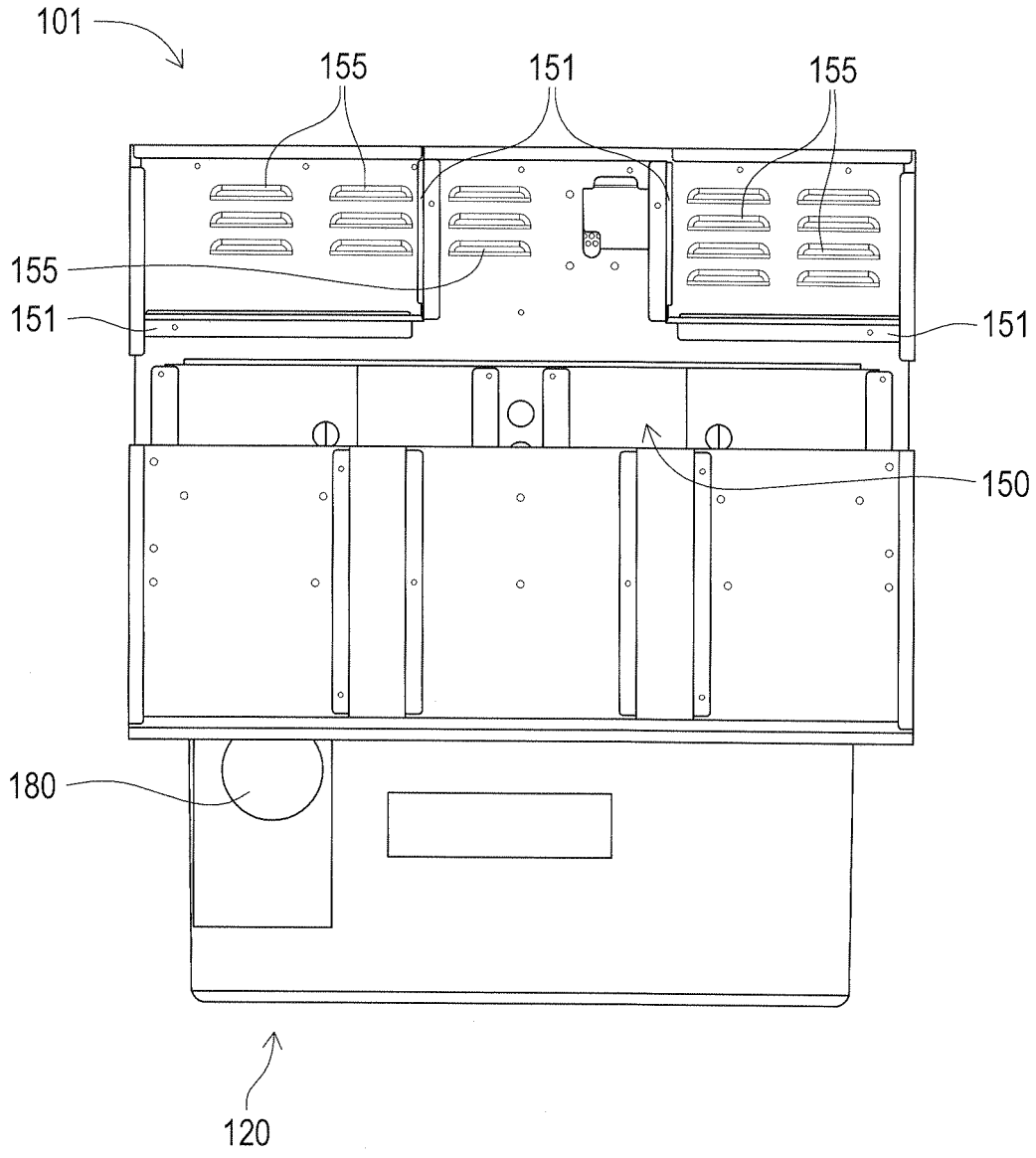
FIG. 9 is a bottom view of the slot machine according to the second embodiment of the present invention.

Next, the bottom surface of the slot machine 101 according to the second embodiment will be described in detail while referring to the drawings. As shown in FIG. 6 and FIG. 9, the slot machine 101 has a plurality of intake holes 155 in the bottom surface of the cabinet 102. The intake holes 155 provide communication between the outside and the inside of the cabinet 102. Accordingly, the intake holes 155 can introduce air outside the cabinet 102 into the inside of the cabinet 102.

The slot machine 101 further has an intake passage 150 at the bottom surface. As shown in FIG. 6, the left and right side surfaces of the cabinet 102 each have a cut-out portion at the lower end thereof. Similarly, the back panel 140 has a cut-out portion on its lower end. The outside of the cabinet 102 communicates with the intake passage 150 through the respective cut-out portions. Accordingly, when the slot machine 101 is installed, the cut-out portions can guide air outside the cabinet into the intake passage 150. The above-mentioned intake holes 155 are formed inside the intake passage 150. Therefore, the intake passage 150 guides air outside the slot machine 101, which is introduced through the cut-out portions, into the intake holes 155.

As described earlier, the left and right side surfaces of the cabinet 102 each have a cut-out portion at the lower end thereof. The air outside the slot machine 101 is introduced into the intake passage through these cut-out portions. Here, if a plurality of slot machines 101 are aligned laterally, cut-out portions at side surfaces of one slot machine 101 are positioned so as to coincide with positions of adjoining cut-out portions of other slot machines 101. In this case, the intake passage 150 of one slot machine 101 communicates with the intake passage 150 of the other slot machine 101. Accordingly, even when arranged in this manner, the slot machine 101 can assuredly take in air through the intake passage 150. As a result, the slot machine 101 can reduce a space for installation in a lateral direction of the slot machine 101. Accordingly, the slot machine 101 can contribute to effective use of spaces in game arcades.

The lower end portion of the back panel 140 has a cut-out portion. This cut-out portion constitutes one end of the intake passage 150. Owing to this, when two slot machines 101 are arranged back to back, the intake passage 150 of one slot machine 101 communicates with the intake passage 150 of the other slot machine 101 through this cut-out portion. Accordingly, even in this case, the slot machine 101 can assuredly take in air through the intake passage 150.

The slot machine 101 has wall portions 151 at its bottom surface. The wall portions 151 are adopted to maintain stiffness of the lower portion of the slot machine 101. It is to be noted that the lower ends of the wall portions 151 are located above the lower ends of the left and right side surfaces of the cabinet 102 and the lower end of the back panel 140. This means that, when the slot machine 101 is installed, the end of the wall portions 151 will not be brought into contact with the surface where the slot machine 101 is installed. Therefore, the intake holes 155 surrounded by the wall portions 151 can also introduce the air outside the cabinet 102.

Next, a flow of air in the cabinet 102 of the slot machine 101 will be explained with reference to the drawings. FIG. 10 is an explanatory diagram illustrating a flow of air in the slot machine 101 according to the second embodiment.

As shown in FIG. 10, the air inside the cabinet 102 is exhausted to the outside of the cabinet 102 through the exhaust holes 145 by drive of exhaust fans 135. Here, the exhaust fans 135 take in the air at the back side of the exhaust fans 135 (i.e., the air inside the cabinet 102) and blow the air taken in toward an exhaust direction (the right direction in FIG. 10). Accordingly, a flow of air takes place inside the cabinet 102, as the exhaust fans 135 take the air inside the cabinet 102. This flow of air is a flow of air ascending from the bottom surface inside the cabinet 102 (refer to FIG. 10). Then, at the outside of the cabinet 102, the air around the intake holes 155 is introduced into the cabinet 102 along the flow of air generated by drive of the exhaust fans 135. At this time, the air outside the cabinet 102 is guided to the proximity of the intake holes 155 through the intake passage 150.

As described above, the air introduced into the cabinet 102 ascends from the bottom inside the cabinet 102. At this time, the air can cool down the components through heat exchange with the components. Specifically, the air exchanges heat with the control board 170 housed in the lower portion of the cabinet 102 to thereby cool down the control board 170. Here, the air is heated through heat exchange with the components. Then, the heated air is exhausted through the exhaust holes 145 to the outside of the cabinet 102 along the flow of air generated by drive of the exhaust fans 135.

In this manner, the slot machine 101 circulates air between the inside and the outside of the cabinet 102. Specifically, as shown in FIG. 10, the air flows in the cabinet 102 from the intake holes 155 in the bottom surface thereof to the exhaust holes 145 at the upper side. Accordingly, the slot machine 101 can cool down the components arranged throughout inside the cabinet 102. As a result, the slot machine 101 can prevent a malfunction caused by the heat generated from the components arranged in the cabinet 102.

As explained above, the slot machine 101 according to the second embodiment has the exhaust holes 145 and the exhaust fans 135. Accordingly, the slot machine 101 can exhaust air heated by the heat of the components to the outside of the cabinet 102. Thus, the slot machine 101 can release the heat generated inside the cabinet 102 to the outside, thereby preventing a malfunction of the components caused by heat. Further, the slot machine 101 is provided with a plurality of exhaust holes 145 in the recess portion 143. The recess portion 143 is formed in the back panel 140 at the backside of the cabinet 102. Accordingly, even when arranged with the back panel 140 in contact with a wall surface of a game arcade, the slot machine 101 can secure a space required to exhaust air in the cabinet 102 (refer to FIG. 10). This makes it possible to install the slot machine 101 in a game arcade with its back panel 140 in contact with a wall surface and the like of the game arcade. As a result, the slot machine 101 can reduce a space required to install. Therefore, the slot machine 101 can contribute to effective use of spaces in game arcades. Further, in the slot machine 101, the recess portion 143 communicates with the upper portion of the cabinet 102 (refer to FIG. 6 and so on). Accordingly, the slot machine 101 can assuredly exhaust heated air in the cabinet 102 through the exhaust holes 145.

In the slot machine 101 according to the second embodiment, the recess portion 143 is formed at a position deviated from the central axis in the width-directional center of the cabinet 102 in a predetermined length to a predetermined direction. The exhaust holes 145 formed on the recess portion 143 are used for exhausting the heat generated from the components and the like. When two slot machines 101 are arranged back to back, the respective recess portions 143 are positioned so as not to face with each other. Therefore, in a case that the slot machines 101 are arranged in this manner, exhaust heat of one slot machine 101 will not obstruct exhaust of the other slot machine 101. In other words, by arranging two slot machines 101 back to back in a game arcade, it is possible to reduce an installation space for these slot machines 101. As a result, the slot machine 101 can further contribute to effective use of spaces in game arcades.

Further, the slot machine 101 has an intake passage 150 at the bottom surface of the cabinet 102. The intake passage 150 has the intake holes 155 which communicate with the inside of the cabinet 102. Therefore, the air outside the cabinet 102 flows into the cabinet 102 through the intake holes 155 in the intake passage 150 by drive of the exhaust fans 135. The air flowing in the cabinet 102 moves upward from the bottom surface and is exhausted to the outside of the cabinet 102 through the exhaust holes 145. This means that the air in the slot machine 101 flows from the lower portion to the upper portion of the cabinet 102. As a result, the slot machine 101 can cool down the entire components housed in the cabinet 102. In other words, the slot machine 101 can more assuredly prevent a malfunction of the components (such as a processor arranged in the control board 170) caused by heat.

Further, the slot machine 101 has cut-out portions at the lower ends of the left, right and back sides of the cabinet 102. The cut-out portions constitute the respective one ends of the intake passage 150. Specifically, when a plurality of slot machines 101 are aligned laterally, the intake passage 150 of one slot machine 101 communicates with the intake passage of the other slot machine 101. Similarly, when two slot machines 101 are installed back to back, the intake passage 150 of one slot machine 101 communicates with the intake passage 150 of the other slot machine 101. Therefore, when a plurality of slot machines 101 are arranged side to side or back to back, the slot machine 101 can assuredly takes in air through the intake passage 150.

The present invention is not limited to the above-described embodiment, and it is obvious that various improvements and modifications can be made thereto without departing from the spirit of the present invention. For instance, the gaming machine according to the present invention is not limited to a slot machine. Specifically, the invention is applicable to various gaming machines (such as a card gaming machine) only if it is provided with a recess portion which has an exhaust hole in the outer peripheral surface of a cabinet thereof. Further, the position of the recess portion in the present invention is not limited to the back side of the cabinet as in the embodiment described above. For instance, it is possible to form a recess portion having an exhaust hole in the side surface of the cabinet in the gaming machine according to the present invention.

Also, in the gaming machine according to the present invention, the number of recess portions having an exhaust hole is not limited to one recess portion as in the embodiment described above. The gaming machine according to the present invention may be provided with a plurality of recess portions in the outer peripheral surface of the cabinet, each of which has an exhaust hole. In this case, such a gaming machine can exhaust air in the cabinet more smoothly. In this case also, such a gaming machine can contribute to effective use of spaces in game arcades.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A gaming machine comprising:

a cabinet comprising:

a control board housed therein, the control board including a processor for executing control with respect to a game, and a display arranged in a front face of the cabinet, the display having a screen for displaying information with respect to the game;

an armrest protruding further frontward from the cabinet than the display and having an upper surface on which a player's arm is put; and a woofer that has an enclosure with an opening to output sounds and a vibrating mechanism including a drive unit and is housed inside the armrest, wherein the upper surface of the armrest is positioned higher than a lower end portion of the screen of the display and includes a horizontally flat portion where a drink is able to be put, wherein the vibrating mechanism is accommodated inside of the enclosure and the opening is opened at a bottom surface of the armrest which is opposite side to the upper surface, and wherein the woofer outputs low pitched sounds and vibrations toward the bottom side of the armrest through the opening and transmits the low pitched sounds and vibrations to the armrest based on a signal from the processor.

2. The gaming machine according to claim 1, further comprising:

a relay board connected to the control board;

wherein the woofer is detachably connected to the relay board, and wherein, through the relay board, the processor controls sound output of the woofer.

3. The gaming machine according to claim 1, wherein the woofer is arranged in a bottom surface of the armrest, and wherein directivity with respect to sound output of the woofer is in a downward direction of the armrest.

4. The gaming machine of claim 1, further comprising a full range speaker that covers a full audible frequency range (20 Hz~20 KHz) of the human being and is installed on a front face of the gaming machine.

5. The gaming machine of claim 4, wherein the woofer outputs sounds specialized in the low pitched frequency range.

6. The gaming machine of claim 5, wherein the processor simultaneously generates a sound effect and a vibration effect by using both the woofer and the full range speaker.

7. A gaming machine comprising:

a cabinet comprising:

a control board housed therein, the control board including a processor for executing control with respect to a game, and a display arranged in a front face of the cabinet, the display having a screen for displaying information with respect to the game;

a relay board connected to the control board;

an armrest protruding further frontward from the cabinet than the display and having an upper surface on which a player's arm is put; and a woofer that has an enclosure with an opening to output sounds and a vibrating mechanism including a drive unit and is housed inside the armrest, wherein the upper surface of the armrest is positioned higher than a lower end portion of the screen of the display and includes a horizontally flat portion where a drink is able to be put, wherein the vibrating mechanism is accommodated inside of the enclosure and the opening is opened at a bottom surface of the armrest which is opposite side to the upper surface, and wherein the woofer outputs low pitched sounds and vibrations toward the bottom side of the armrest through the opening and transmits the low pitched sounds and vibrations to the armrest based on a signal from the processor, wherein the woofer is detachably connected to the relay board, and wherein, through the relay board, the processor controls the sound output of the woofer.

* * * * *